US010361505B2

(12) United States Patent
Liao

(10) Patent No.: US 10,361,505 B2
(45) Date of Patent: Jul. 23, 2019

(54) DUAL-COVER STRUCTURE PROTECTIVELY ENCLOSING SOCKET

(71) Applicant: FOXCONN INTERCONNECT TECHNOLOGY LIMITED, Grand Cayman (KY)

(72) Inventor: Fang-Jwu Liao, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/854,831

(22) Filed: Dec. 27, 2017

(65) Prior Publication Data

US 2018/0183176 A1 Jun. 28, 2018

(30) Foreign Application Priority Data

Dec. 28, 2016 (CN) ..... 2016 1 1237168

(51) Int. Cl.

| | |
|---|---|
| ***H01R 13/447*** | (2006.01) |
| ***H01R 13/52*** | (2006.01) |
| ***H01R 24/28*** | (2011.01) |
| ***H01R 43/18*** | (2006.01) |
| *H01R 107/00* | (2006.01) |

(52) U.S. Cl.

CPC ..... *H01R 13/5213* (2013.01); *H01R 24/28* (2013.01); *H01R 43/18* (2013.01); *H01R 2107/00* (2013.01)

(58) Field of Classification Search

CPC ..... H01R 13/447; H01R 43/205; H01R 4/22; H01R 4/70

USPC ..... 439/135, 41, 521

See application file for complete search history.

(56) References Cited

U.S. PATENT DOCUMENTS

| | | | | |
|---|---|---|---|---|
| 7,140,890 | B1 * | 11/2006 | Ju | H01R 43/205 439/135 |
| 7,527,507 | B2 * | 5/2009 | Liao | H01R 13/447 439/135 |
| 7,530,822 | B2 * | 5/2009 | Liao | H01R 43/205 439/135 |
| 8,142,201 | B2 * | 3/2012 | Fan | H05K 7/1007 439/135 |
| 8,622,278 | B1 * | 1/2014 | Alvarez | H05K 13/0465 228/212 |

(Continued)

FOREIGN PATENT DOCUMENTS

| | | |
|---|---|---|
| CN | 201252194 Y | 6/2009 |
| CN | 202142665 U | 2/2012 |
| CN | 205070140 U | 3/2016 |

*Primary Examiner* — Hien D Vu

(74) *Attorney, Agent, or Firm* — Wei Te Chung; Ming Chieh Chang

(57) ABSTRACT

An electrical connector assembly includes an electrical connector and a cover set used with the connector. The connector includes an insulative housing and a plurality of contacts retained in the housing. Each contact extends beyond both the upper surface and the lower surface of the base of the housing. The cover set includes an upper cover and a lower cover independently detachably attached to the housing and respectively covering the upper portion and the lower portion of the housing for protecting the extending exposed contacts wherein the upper cover further provides holding/suction device for mounting the connector to the printed circuit board after the lower cover is removed.

9 Claims, 10 Drawing Sheets

(56) References Cited

U.S. PATENT DOCUMENTS

| | | | | |
|---|---|---|---|---|
| 8,747,120 | B2 * | 6/2014 | Terhune, IV | H05K 7/1053 439/41 |
| 8,939,776 | B2 | 1/2015 | Liang et al. | |
| 2008/0045048 | A1 * | 2/2008 | Ma | H05K 7/1061 439/73 |

* cited by examiner

DUAL-COVER STRUCTURE PROTECTIVELY ENCLOSING SOCKET

1. FIELD OF THE DISCLOSURE

The invention is related to an electrical connector assembly, and particularly to the electrical connector protected by upper and lower covers.

2. DESCRIPTION OF RELATED ARTS

U.S. Pat. No. 7,883,345 discloses an electrical connector associated with a pick-up cap for protecting and mounting consideration. Anyhow, the contact tails outside of the bottom surface of the housing are exposed without protection disadvantageous.

A cover with full protection and easy mounting for the electrical connector is desired.

SUMMARY OF THE DISCLOSURE

An electrical connector assembly includes an electrical connector and a cover set used with the connector. The connector includes an insulative housing and a plurality of contacts retained in the housing. Each contact extends beyond both the upper surface and the lower surface of the base of the housing. The cover set includes an upper cover and a lower cover independently detachably attached to the housing and respectively covering the upper portion and the lower portion of the housing for protecting the extending exposed contacts wherein the upper cover further provides holding/suction device for mounting the connector to the printed circuit board after the lower cover is removed.

DETAILED DESCRIPTION OF THE PREFERRED EMBODIMENT

Figure 1:
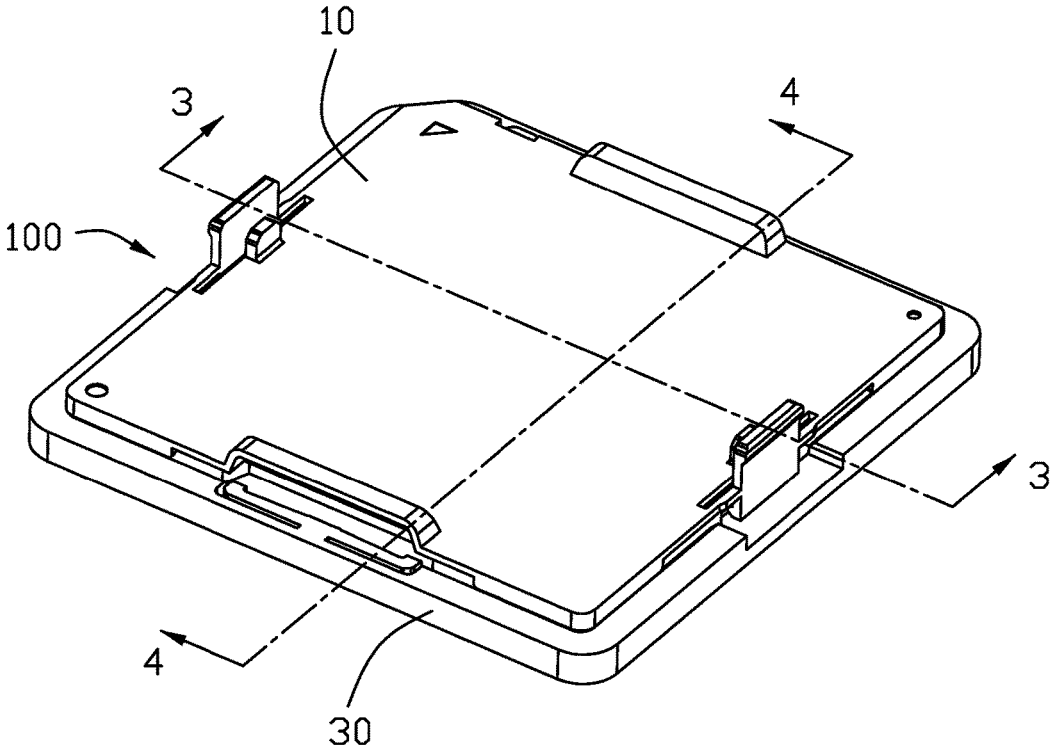
FIG. 1 is a perspective view of the electrical connector assembly of the invention including an electrical connector and a cover unit including an upper cover and a lower cover.
Figure 2:
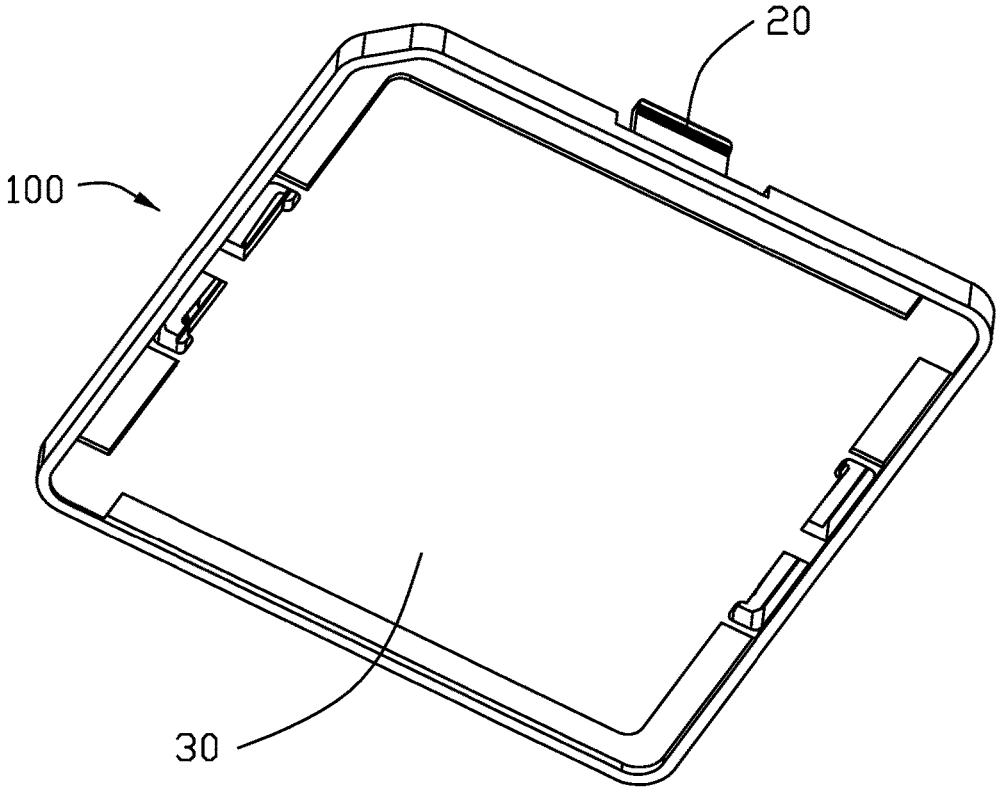
FIG. 2 is another perspective view of the electrical connector assembly of FIG. 1.
Figure 3:
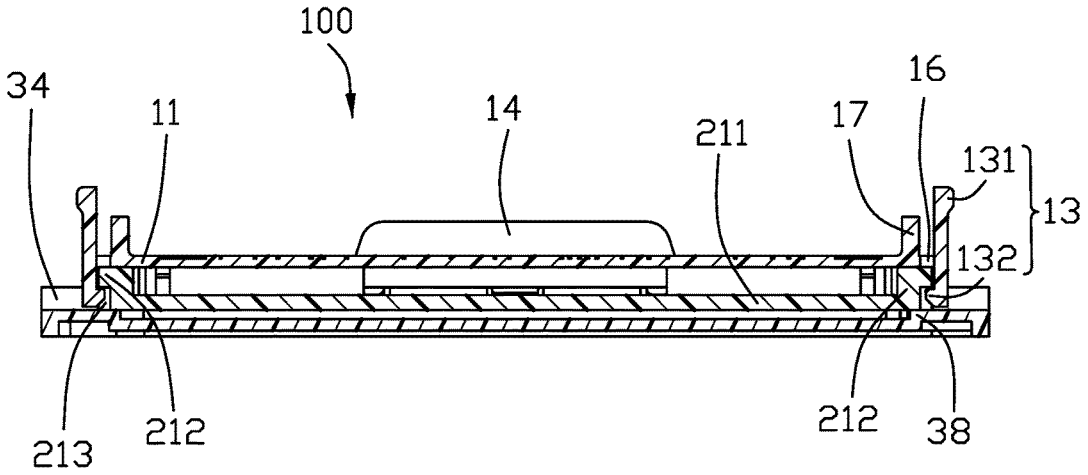
FIG. 3 is a cross-sectional view of the electrical connector assembly of FIG. 1.
Figure 4:
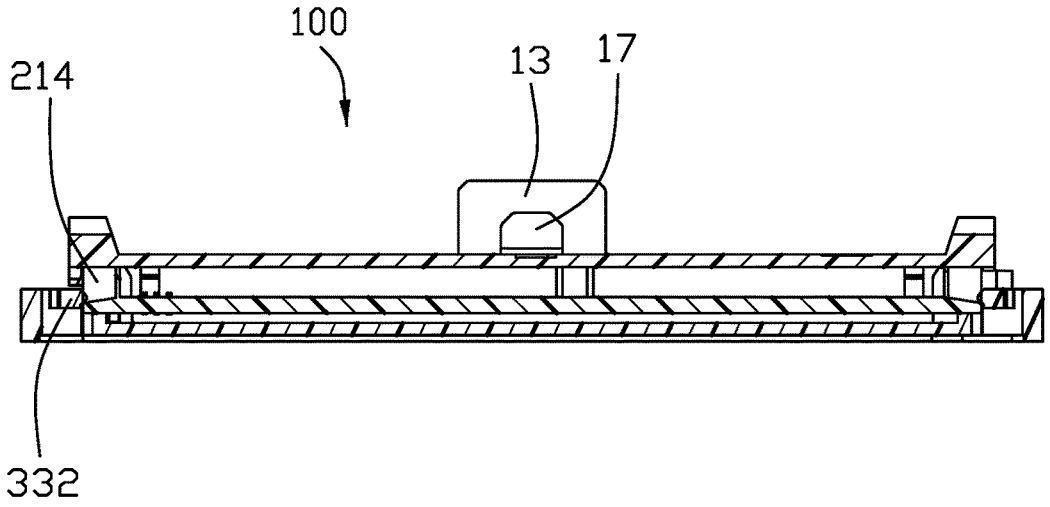
FIG. 4 is another cross-sectional view of the electrical connector assembly of FIG. 1.
Figure 5:
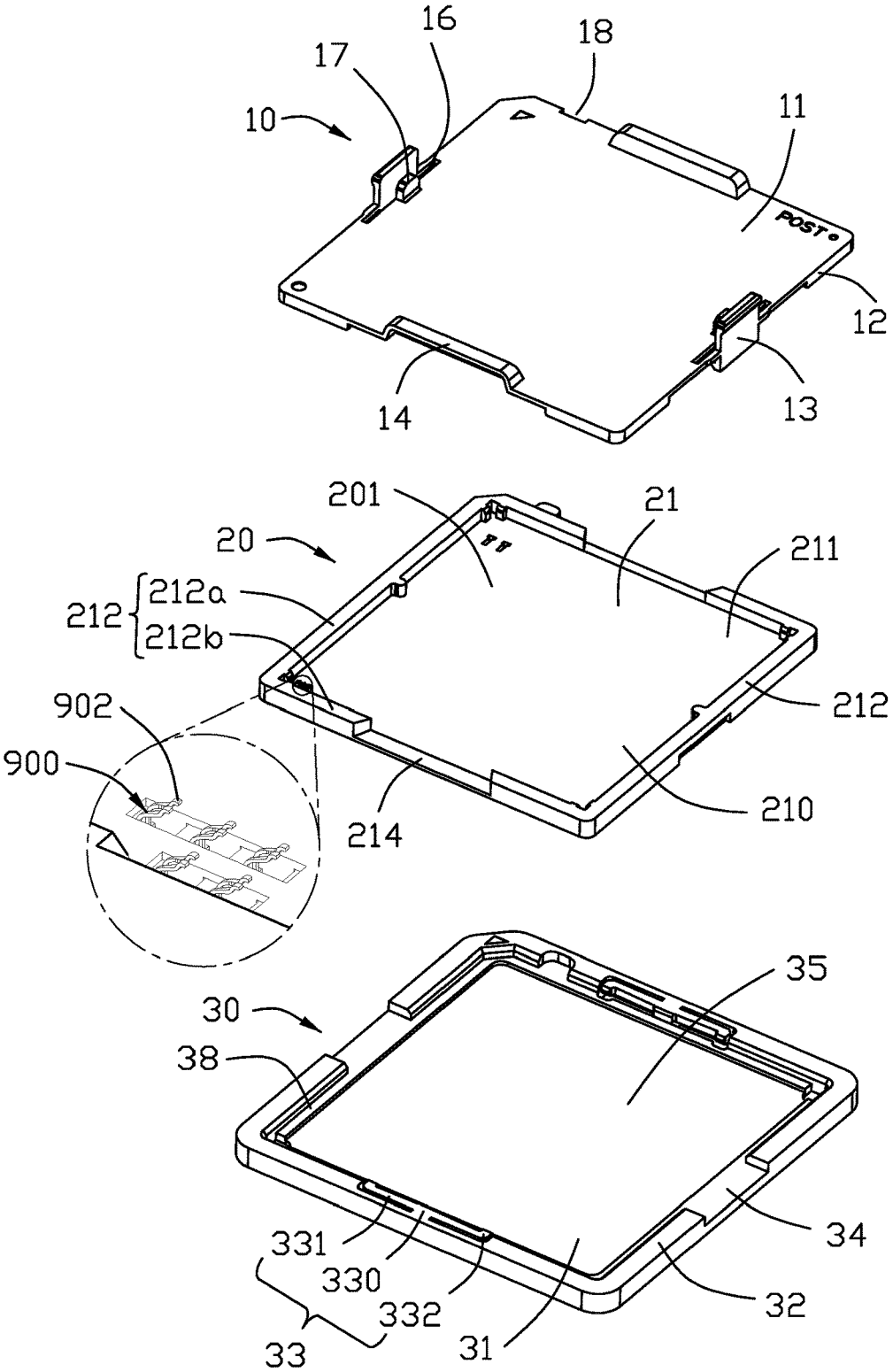
FIG. 5 is an exploded perspective view of the electrical connector assembly of FIG. 1 to show the electrical connector, the upper cover and the lower cover.
Figure 6:
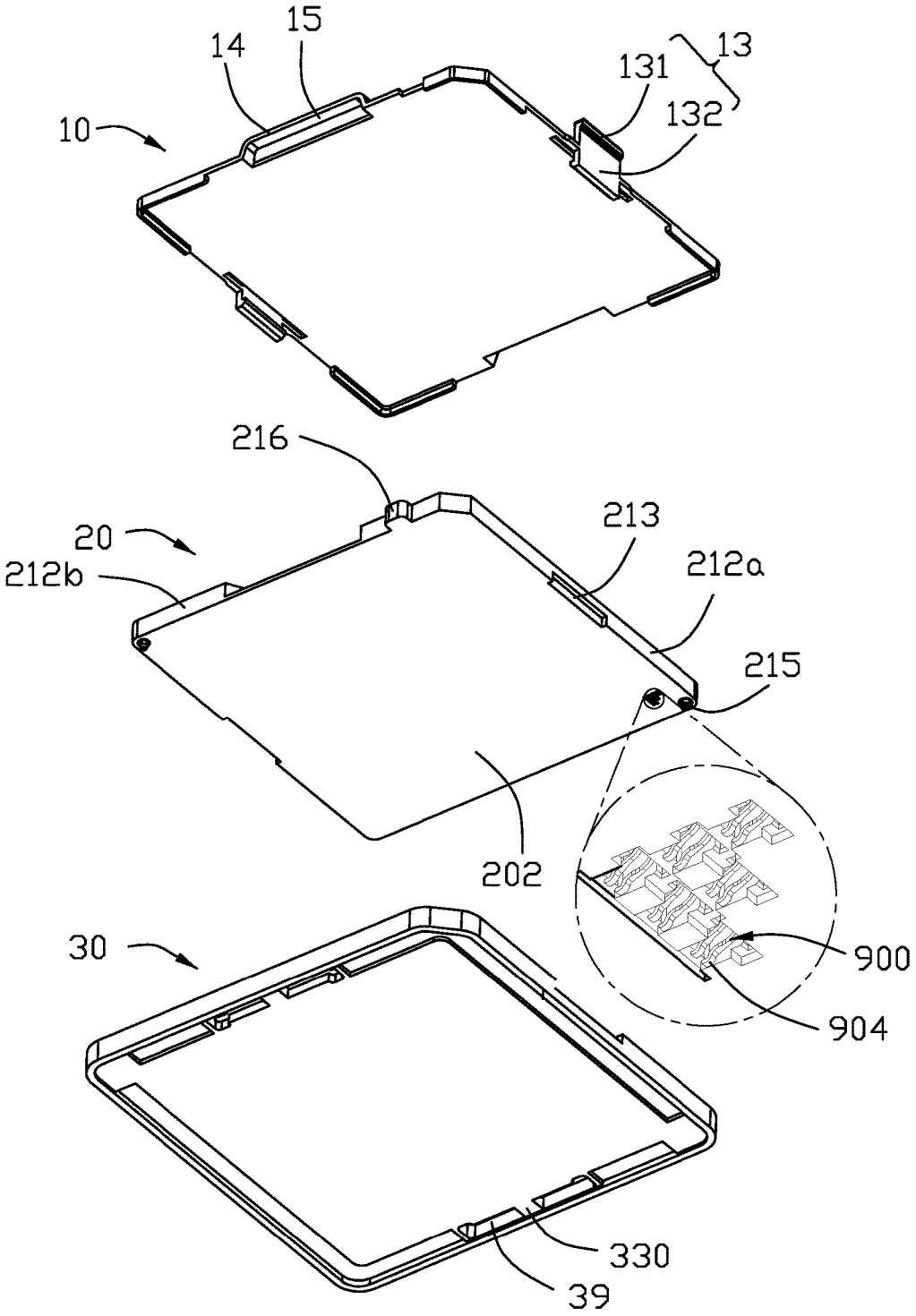
FIG. 6 is another exploded perspective view of the electrical connector assembly of FIG. 5.
Figure 7:
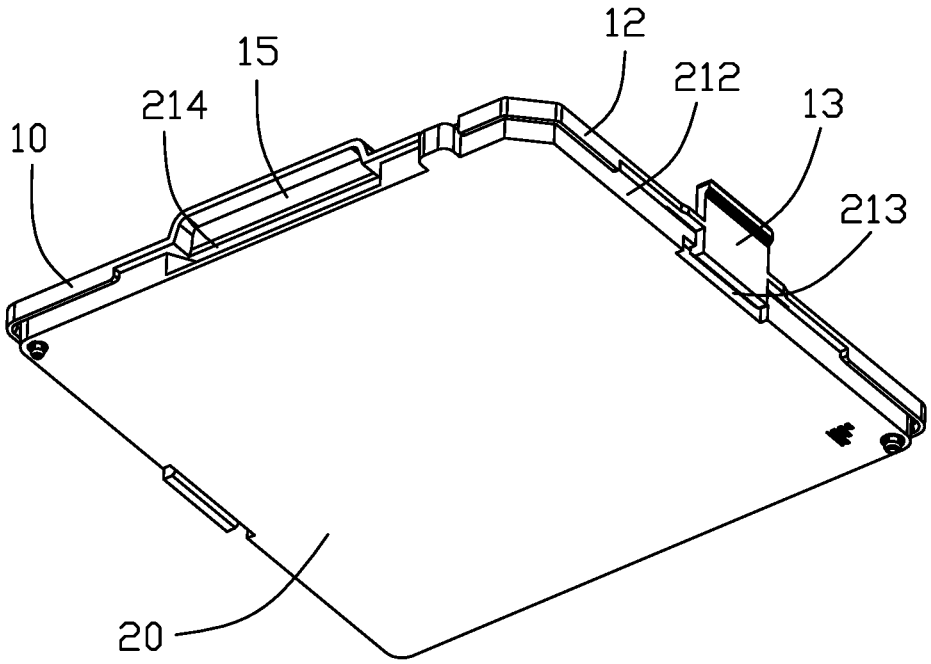
FIG. 7 is an assembled perspective view of the electrical connector with the upper cover of the electrical connector assembly of FIG. 1.
Figure 8:
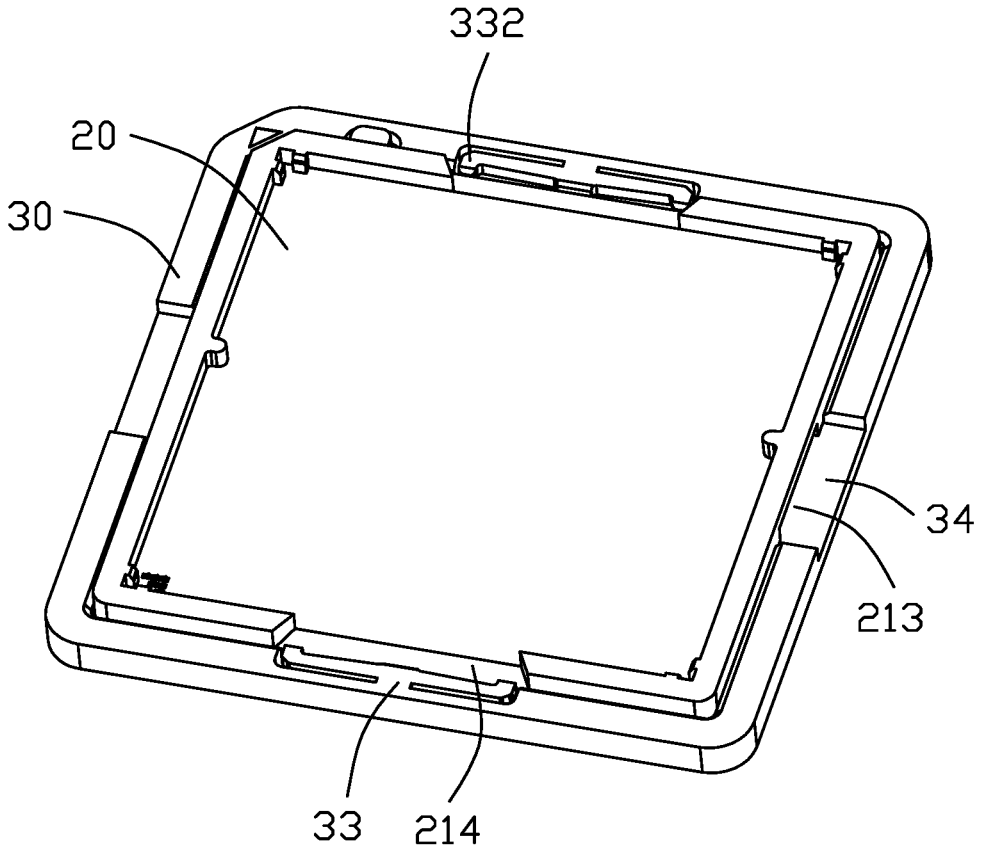
FIG. 8 is an assembly perspective view of the electrical connector with the lower cover of the electrical connector assembly of FIG. 1.
Figure 9:
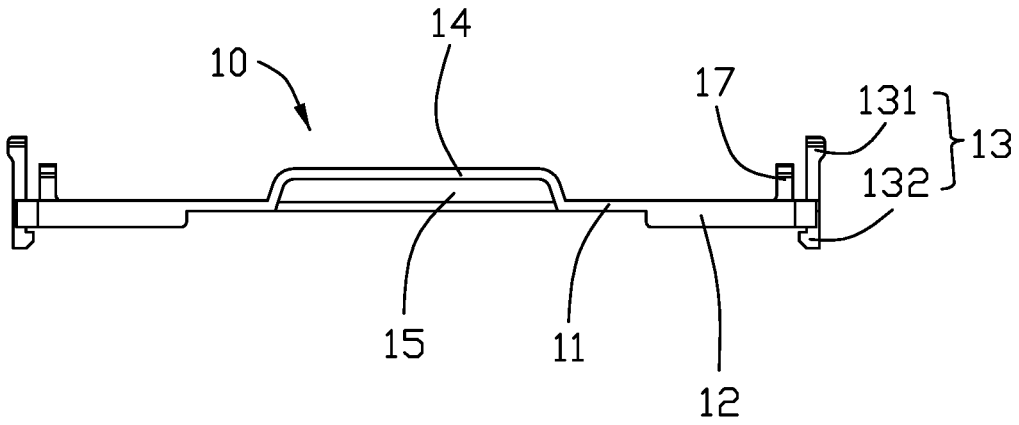
FIG. 9 is a side view of the upper cover of the electrical connector assembly of FIG. 1.
Figure 10:
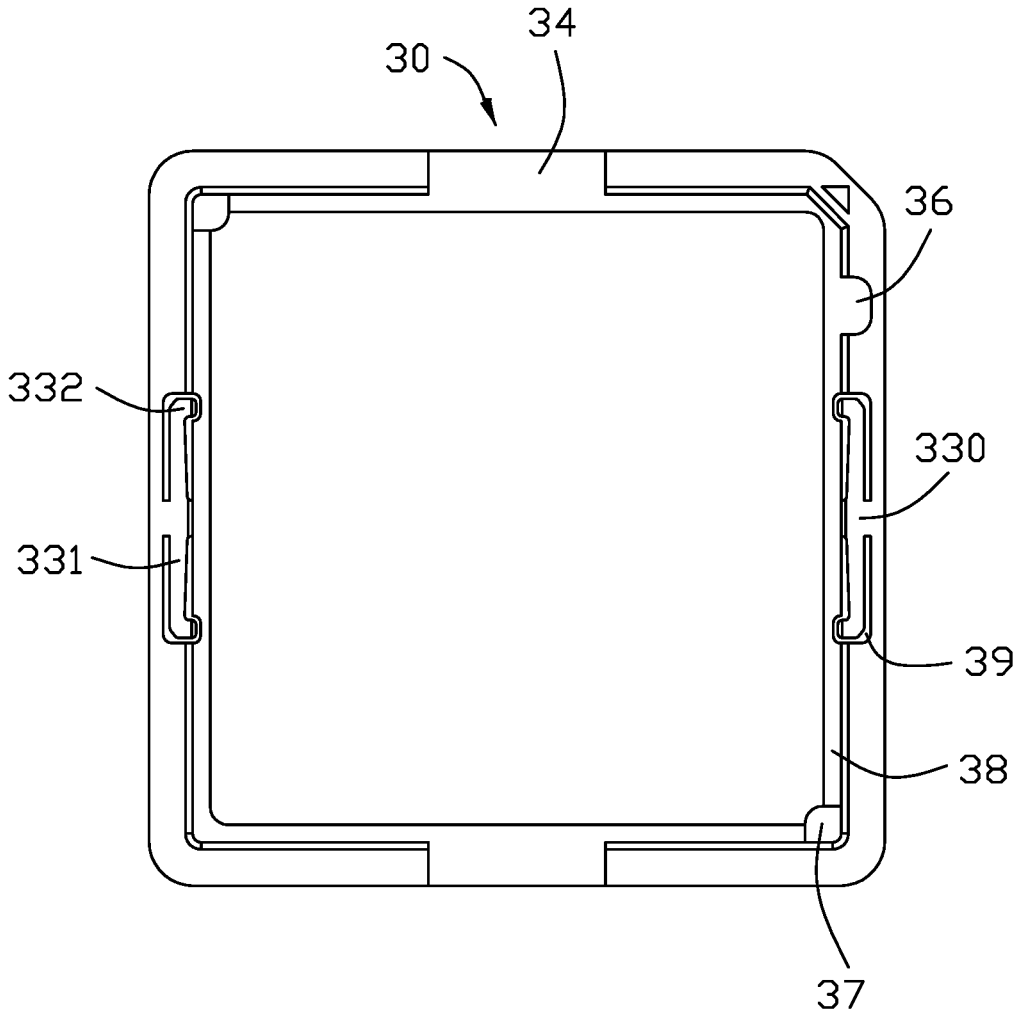
FIG. 10 is a top view of the lower cover of the electrical connector assembly of FIG. 1.

Reference will now be made in detail to the embodiments of the present disclosure. Referring to FIGS. 1-10, an electrical connector assembly 100 includes an electrical connector 20 and a cover unit detachable attached to the electrical connector 20. The electrical connector 20 for connecting an electronic package (not shown) to a printed circuit board (not shown), includes an insulative housing 21, a plurality of contacts 900 retained in the housing 21.

The housing 21 forms a base 211 with opposite upper surface 201 and lower surface 202. Each contact 900 forms a deflectable upper arm 902 and a deflectable lower arm 904 respectively extending beyond the upper surface 201 upwardly and the lower surface 202 downwardly. Two pairs of side walls 212 extend from four sides of the base 211 and cooperate with the base 211 to commonly form a receiving cavity 210. The deflectable upper arm 902 extends into the receiving cavity 210. Understandably, during using, the electronic package (not shown) is receive within the receiving cavity 210 and mechanically and electrically connected to the upper arm 902, and the printed circuit board (not shown) is mechanically and electrically connected to the lower arm 904. The housing 21 defines a first direction and a second direction perpendicular to each other wherein a pair of side walls 212*a* extend along the first direction and a pair of side wall 212*b* extend in the second direction. Each side wall 212*a* forms a first recess 213 facing downwardly and each said wall 212*b* forms a second recess 214 facing upwardly. The second recess 214 forms a guiding surface.

The cover unit includes an upper cover 10 covering the upper surface 201 and a lower cover 30 covering the lower surface 202 so as to protectively cover the upper arm 902 and the lower arm 904, respectively for dustproof.

The upper cover 10 includes a top plate 11 and a side part 12 downwardly extending from respective sides of the top plate 11. The side part 12 cooperates with the top plate 11 to commonly form a chamber to receive the housing 21 of the electrical connector 20. The top plate 11 abuts against the side walls 212 and the side part 12 covers the exterior surface of the side walls 212. The upper cover 10 includes at the corresponding sides of the top plate 11 a pair of first latches 13 each extending in the first direction and including an upper operation section 131 and a lower hook 132 as a lever. The hook 132 of the first latch 13 is received within the first recess 213. Notably, inward movement of the operation section 131 may result in disengagement of the hook 132 from the first recess 213. A slit 16 is formed in the top plate 11 for allowing inward movement of the operation section 131 of the first latch 13. A pair of stopper 17 are formed on the top plate 11 inside the corresponding operation sections 131, respectively, for preventing over-deflection of the operation section 131. A pair of holding sections 14 are formed on the corresponding sides of the top plate 11, each extending along the second direction and forming a space 15 thereunder for finger holding. The space 15 communicates with the corresponding second recess 214 in the vertical direction. Understandably, the pair of holding sections 14 allows the user to move the upper cover 10 with the associated/latched electronic connector 20 for shipping or packaging or mounting of the electrical connector 20.

The lower cover 30 includes a bottom plate 31 and the side wall 32 extending upwardly from four sides of the bottom plate 31 to cooperate with the bottom plate 31 for commonly forming a receiving space 35. A supporting section 38 is formed on the bottom plate 31 around the side wall 32. A pair of second latches are formed on the side wall 32, extending into the receiving space 35. The second latch 33 includes a horizontal bar 331 and a pair of hooks 332 at two opposite ends of the horizontal bar 331. The horizontal bar 331 forms a supporting pivot 330 linked to the side wall 32 and equidistantly spaced from the pair or hooks 332. A gap 39 is formed between the side wall 32 and the horizontal bar 331 for allowing backward movement of the hook 332 which extends into the receiving space 35 and is adapted to be received within the second recess 214 of the housing 21 when assembled. Notably, the side wall 32, the second hook 332 and the supporting pivot 330 are equipped with the chamfers for facilitating assembling the lower cover 30 upwardly to the housing 21 of the electrical connector 20. Correspondingly, the second recess 214 is also equipped with the chamfer for facilitating disengagement of the hook 332 therefrom to allow forcible removal of the lower cover 30 from the housing 21 of the electrical connector 20. Understandably, during assembling or disassembling, the second hook 332 experiences outward deflection due to confrontation with the corresponding side wall 212*b* under the second recess 214. On the other hand, the lower cover 30 further includes a pair of recessions 34 in the corresponding side wall 32 to accommodate the corresponding first hook 132 of the top cover 10.

The housing 21 further includes two different positioning posts 215 extending downwardly from the lower surface 202 of the base 211 for mounting to the printed circuit board (not shown). Correspondingly, the lower cover 30 forms a pair of holes 37 to receiving the posts 215 during assembling. The housing 21 further forms an orientation block 216 so that the upper cover 10 forms a hole 18 and the lower cover 30 forms another hole 36 for commonly compliance with the orientation block 216.

The operation way of assembling/disassembling the electrical connector 20 with regard to both the upper cover 10 and the lower cover 30 is as follows. Generally, the upper cover 10 is attached to the housing 21 via engagement of the hook 132 in the first recess 213, and the lover cover 30 is attached to the housing 21 via engagement of the hook 332 in the second recess 214 as a full protection combination for safe shipping/handling so that the upper arm 902 and the lower arm 902 of the contact 900 are protective covered without risks of damage. During mounting the electrical connector 20 to the printed circuit board (not shown), by holding the holding sections 14, the lower cover 30 is forcibly downwardly removed from the housing 21 due to forcible disengagement of the hook 332 from the second recess 214. The assembly of the upper cover 10 and the electrical connector 20 is further moved to the corresponding position on the printed circuit board either by suction or by holding and further downward pressed to have the positioning posts 215 received within the corresponding holes in the printed circuit board. The top cover 10 is removed from the housing 21 to expose the receiving cavity 210 for electronic package installation by inwardly deflecting the first latch 131 via imposing forces upon the operation section 131 to disengage the hook 132 from the first recess 213. Understandably, the second latch 33 may be equipped with the corresponding operation section as the first latch 13 for easy detachment instead of forcible disengagement. Alternately, the lower cover may be attached to the upper cover rather than to the housing if no sufficient space is available between the lower cover and the housing after attachment of the upper cover to the housing.

While a preferred embodiment according to the present disclosure has been shown and described, equivalent modifications and changes known to persons skilled in the art according to the spirit of the present disclosure are considered within the scope of the present disclosure as described in the appended claims.

What is claimed is:

1. An electrical connector assembly comprising:

an electrical connector enclosed in a cover unit including an upper cover and a lower cover, the electrical connector including an insulative housing with a plurality of contacts therein, the housing forming opposite upper surface and lower surface in a vertical direction, each of said contacts including opposite upper arm and lower arm and respectively extending beyond the upper surface and the lower surface in the vertical direction;

the upper cover detachably latched downwardly upon the housing to protectively cover the upper surface and the upper arms of the contacts; and the lower cover detachably latched upwardly upon the housing to protectively cover the lower surface and the lower arms of the contacts;

wherein the upper cover and the lower cover are independently detachably attached to the housing without affecting each other;

wherein the upper cover includes a pair of first latches engaged within a pair of first recesses in the housing;

wherein the lower cover includes a pair of second latches engaged within a pair of second recesses in the housing; and wherein either the first latch or the second latch is equipped with an operation section opposite to a hook thereof.

2. The electrical connector assembly as claimed in claim 1, wherein said pair of first recesses and said pair of second recesses are located at different sides of the housing.

3. The electrical connector assembly as claimed in clam 1, wherein said pair of second latches are hidden from an exterior when the lower cover is assembled to the housing, and disengagement of the second latch from the second recess is made by downward forces applied upon the lower cover.

4. The electrical connector assembly as claimed in claim 1, wherein the upper cover further includes a pair of holding sections for finger holding.

5. The electrical connector assembly as claimed in claim 1, wherein the upper cover includes a top plate for both dustproof and suction.

6. The electrical connector assembly as claimed in claim 1, wherein the housing includes an orientation block or a positioning post, and at least one of the upper cover and the lower cover forms a hole to accommodate said orientation block or the positioning post.

7. The electrical connector assembly as claimed in claim 1, wherein at least one of the upper arm and the lower arm is resilient.

8. An electrical connector assembly comprising:

an electrical connector enclosed in a cover unit including an upper cover and a lower cover, the electrical connector including an insulative housing with a plurality of contacts therein, the housing forming opposite upper surface and lower surface in a vertical direction;

the upper cover detachably latched downwardly upon the electrical connector to protectively cover the upper surface; and the lower cover detachably latched upwardly upon the electrical connector to protectively cover the lower surface;

wherein the upper surface and the lower surface are not exposed to an exterior upwardly and downwardly but hidden respectively behind the upper cover and the lower cover in the vertical direction;

wherein the upper cover and the lower cover are independently detachably attached to the housing without affecting each other;

wherein the upper cover includes a pair of first latches engaged within a pair of first recesses in the housing;

wherein the lower cover includes a pair of second latches engaged within a pair of second recesses in the housing; and wherein each of the latches of the upper cover includes an operation section for finger operation for easy disengagement thereof.

9. The electrical connector assembly as claimed in claim 8, wherein the latch of the lower cover has no operation section for finger operation but requiring a forcible disengagement thereof.

* * * * *